US010129650B2

(12) United States Patent
Huang

(10) Patent No.: US 10,129,650 B2
(45) Date of Patent: Nov. 13, 2018

(54) VIBRATION UNIT FOR ACOUSTIC ARRANGEMENT

(71) Applicant: Tang Band Industries Co., Ltd., Ningbo, Zhejiang (CN)

(72) Inventor: Hsinmin Huang, Ningbo (CN)

(73) Assignee: TANG BAND INDUSTRIES CO., LTD., Ningbo, Zhejiang (CN)

( * ) Notice: Subject to any disclaimer, the term of this patent is extended or adjusted under 35 U.S.C. 154(b) by 108 days.

(21) Appl. No.: 14/243,867

(22) Filed: Apr. 2, 2014

(65) Prior Publication Data

US 2015/0181343 A1 Jun. 25, 2015

(30) Foreign Application Priority Data

Dec. 19, 2013 (CN) ..... 2013 1 0705968
Dec. 19, 2013 (CN) ..... 2013 2 0844079 U

(51) Int. Cl.
*H04R 7/20* (2006.01)

(52) U.S. Cl.
CPC ..... *H04R 7/20* (2013.01); *H04R 2231/003* (2013.01); *H04R 2307/201* (2013.01); *H04R 2307/204* (2013.01); *H04R 2307/207* (2013.01)

(58) Field of Classification Search
CPC .... H04R 31/00; H04R 31/003; H04R 31/006; H04R 9/043; H04R 7/16; H04R 7/00; H04R 7/18; H04R 2231/003; H04R 2307/027; H04R 2307/207; H04R 1/06; H04R 7/20; H04R 2307/201; H04R 2307/204; H04R 9/04; F16J 3/00; G10K 13/00
See application file for complete search history.

(56) References Cited

U.S. PATENT DOCUMENTS 4,324,312 A * 4/1982 Durbin ..... H04R 1/06 181/171
8,397,861 B1 * 3/2013 Xu ..... H04R 7/18 181/171
8,885,868 B2 * 11/2014 Davidson et al. ..... 381/404
2003/0070869 A1 * 4/2003 Hlibowicki ..... 181/172
2006/0162993 A1 * 7/2006 Honda et al. ..... 181/172
2008/0296086 A1 * 12/2008 Subramaniam et al. ..... 181/142
(Continued)

OTHER PUBLICATIONS

Sonic Electronix, Kicker QS60.2 (QS60.2), 2008, www.sonicelectronix.com.*
(Continued)

*Primary Examiner* — Fan Tsang
*Assistant Examiner* — Angelica M McKinney
(74) *Attorney, Agent, or Firm* — Raymond Y. Chan; David and Raymond Patent Firm

(57) ABSTRACT

A vibration unit for an acoustic arrangement includes an encircling frame, a vibration member, and a weaving suspension extended between the vibration member and the encircling frame for enabling the vibration member to be reciprocatingly moved. The weaving suspension includes a plurality of reinforcing ribs radially and outwardly extended from the vibration member to the encircling frame to form a weaving-like structure, such that the vibration member is prohibited to move along a rib extending direction of each of the reinforcing ribs to ensure the vibration member to be reciprocatingly moved in a linear direction.

20 Claims, 6 Drawing Sheets

(56) References Cited

U.S. PATENT DOCUMENTS

| | | | | |
|---|---|---|---|---|
| 2009/0139794 | A1* | 6/2009 | Silver | H04R 7/20 181/171 |
| 2010/0098271 | A1* | 4/2010 | Mundorf | 381/162 |
| 2011/0305355 | A1* | 12/2011 | Horigome et al. | 381/162 |
| 2015/0063609 | A1* | 3/2015 | Huang | 381/191 |
| 2015/0139477 | A1* | 5/2015 | Tripp et al. | 381/398 |

OTHER PUBLICATIONS

Kicke QS Component System, QS65.2/QS60.2 Owner's Manual, Nov. 21, 2008, All pages.*

* cited by examiner

VIBRATION UNIT FOR ACOUSTIC ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a diaphragm for an acoustic device, and more particular to a vibration unit for an acoustic arrangement, wherein the vibration unit comprises a weaving suspension extended from a vibration member to ensure the vibration member to be reciprocatingly moved in one direction for sound reproduction.

Description of Related Arts

A conventional acoustic device, such as a speaker, generally comprises a speaker frame, a vibration diaphragm supported by the speaker frame, a voice coil coupled at the vibration diaphragm, and a magnetic coil unit magnetically inducing with voice coil in order to drive the vibration diaphragm to vibrate for sound reproduction. In particular, the vibration diaphragm is mounted at an opening of the speaker frame, wherein when the voice coil is magnetically induced to reciprocatingly move, the vibration diaphragm is driven to vibrate correspondingly. However, the vibration direction of the vibration diaphragm is uncontrollable, such that the vibration diaphragm cannot reproduce good sound quality. In order to achieve better sound quality, the vibration diaphragm should only be reciprocatingly moved one direction with even amplitude. For example, when the vibration diaphragm is placed horizontally, the vibration diaphragm should only be reciprocatingly moved in a vertical (up-and-down) direction while the upward displacement of the vibration diaphragm should be the same as the downward displacement of the vibration diaphragm.

In order to enable the reciprocatingly movement of the vibration diaphragm, the vibration diaphragm comprises a suspension extended to the speaker frame as a surrounding of the vibration diaphragm. Accordingly, the suspension is made of elastic material and is formed in U-shape such that the suspension provides an elastic force to enable the vibration diaphragm to be reciprocatingly moved in response to the movement of the voice coil. However, the suspension not only allows the vibration diaphragm to move in a vertical direction, for example, but also unavoidably permits the vibration diaphragm to move in a lateral direction. Accordingly, the unwanted lateral movement of the vibration diaphragm will cause the unbalanced movement of the voice coil. Once the movement of the voice coil is not aligned with its center axis, the voice coil may scratch the inner side of the speaker frame. The protective coating of the voice coil will be gradually damaged. The peak of the suspension is upwardly protruded from a top side of the vibration diaphragm, such that the vibration diaphragm requires relatively larger space to incorporate with the suspension. The protruding portion of the suspension will be damaged easily by any external object.

Furthermore, due to the U-shaped cross section of the suspension, the upward displacement of the vibration diaphragm is not the same as the downward displacement thereof. In other words, the vibration diaphragm is not reciprocatingly moved in a linear manner. For example, when the suspension has the inverted U-shaped cross section, the upward displacement of the vibration diaphragm is larger than the downward displacement thereof. Especially for the acoustic device to generate the sound at low frequency, the vibration diaphragm requires a relatively large amplitude to be reciprocatingly vibrated. In other words, the suspension will affect the sound reproduction at low frequency.

SUMMARY OF THE PRESENT INVENTION

The invention is advantageous in that it provides a vibration unit for an acoustic arrangement, wherein the vibration unit comprises a weaving suspension extended from a vibration member to ensure the vibration member to be reciprocatingly moved in one direction for sound reproduction.

Another advantage of the invention is to a vibration unit for an acoustic arrangement, wherein a plurality of reinforcing ribs are radially extended from the vibration to form a weaving-like structure in order to prohibit the vibration member to move along a rib extending direction of each of the reinforcing ribs. Therefore, the vibration member can be stably moved reciprocatingly in one direction.

Another advantage of the invention is to a vibration unit for an acoustic arrangement, wherein a plurality of displacement chambers are radially formed between the vibration member and the encircling frame to only allow the weaving suspension to be radially stretched in a stretchable direction along two diagonal corners of the displacement chamber, so as to ensure the vibration member to be reciprocatingly moved in a linear direction.

Another advantage of the invention is to a vibration unit for an acoustic arrangement, wherein a plurality of first and second skewed ribs are extended from the vibration member and are intersected with each other to form the weaving-like structure and to define the displacement chambers.

Another advantage of the invention is to a vibration unit for an acoustic arrangement, wherein the vibration unit is relative flat and thin that there is no protrusion at neither top nor bottom side of the vibration.

Another advantage of the invention is to a vibration unit for an acoustic arrangement, wherein the weaving suspension provides higher sound quality, improve durability, and enhance safety for the acoustic arrangement.

Another advantage of the invention is to a vibration unit for an acoustic arrangement, wherein the weaving suspension requires minimum installation space in the frame, such that the acoustic arrangement is adapted to equip with any compact product.

Another advantage of the invention is to a vibration unit for an acoustic arrangement, wherein the manufacturing steps for making the vibration unit is simple so as to lower the manufacturing cost while being time effective.

Another advantage of the invention is to a vibration unit for an acoustic arrangement, which does not require to alter the original structural design of the acoustic arrangement, so as to minimize the manufacturing cost of the acoustic arrangement incorporating with the vibration unit.

Another advantage of the invention is to a vibration unit for an acoustic arrangement, wherein no expensive or complicated structure is required to employ in the present invention in order to achieve the above mentioned objects. Therefore, the present invention successfully provides an economic and efficient solution for providing a compact configuration for the acoustic arrangement and for enhancing the output sound quality.

Additional advantages and features of the invention will become apparent from the description which follows, and may be realized by means of the instrumentalities and combinations particular point out in the appended claims.

According to the present invention, the foregoing and other objects and advantages are attained by a vibration unit for an acoustic arrangement which comprises a voice coil being induced to reciprocatingly move. The vibration unit comprises an encircling frame defining a vibration cavity therewithin and a vibration member disposed in the vibration cavity of the encircling frame for being coupled with the voice coil.

The vibration unit further comprises a weaving suspension comprising a plurality of reinforcing ribs radially and outwardly extended from a peripheral edge of the vibration member to the encircling frame for enabling the vibration member to be reciprocatingly moved in response to a movement of the voice coil, wherein the reinforcing ribs are made of elastic material and are extended to form a weaving-like structure that the vibration member is prohibited to move along a rib extending direction of each of the reinforcing ribs, so as to ensure the vibration member to be reciprocatingly moved in a linear direction within the vibration cavity in response to a movement of the voice coil for sound reproduction.

Alternatively, the weaving suspension comprises a plurality of displacement chambers radially formed between a peripheral edge of the vibration member and the encircling frame for enabling the vibration member to be reciprocatingly moved in response to a movement of the voice coil, wherein each of the displacement chambers has a predetermined shape to only allow the weaving suspension to be radially stretched in a stretchable direction along two diagonal corners of the displacement chamber, so as to ensure the vibration member to be reciprocatingly moved in a linear direction within the vibration cavity in response to a movement of the voice coil for sound reproduction.

In accordance with another aspect of the invention, the present invention comprises a method of manufacturing a vibration unit for an acoustic arrangement, which comprises the following steps.

(1) Dispose an encircling frame and a vibration member in a mold at a position that the vibration member is located within a vibration cavity of the encircling frame in a planar manner.

(2) Form a weaving suspension between a peripheral edge of the vibration member and the encircling frame in a weaving-like structure, by mold injection, for enabling the vibration member to be reciprocatingly moved.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
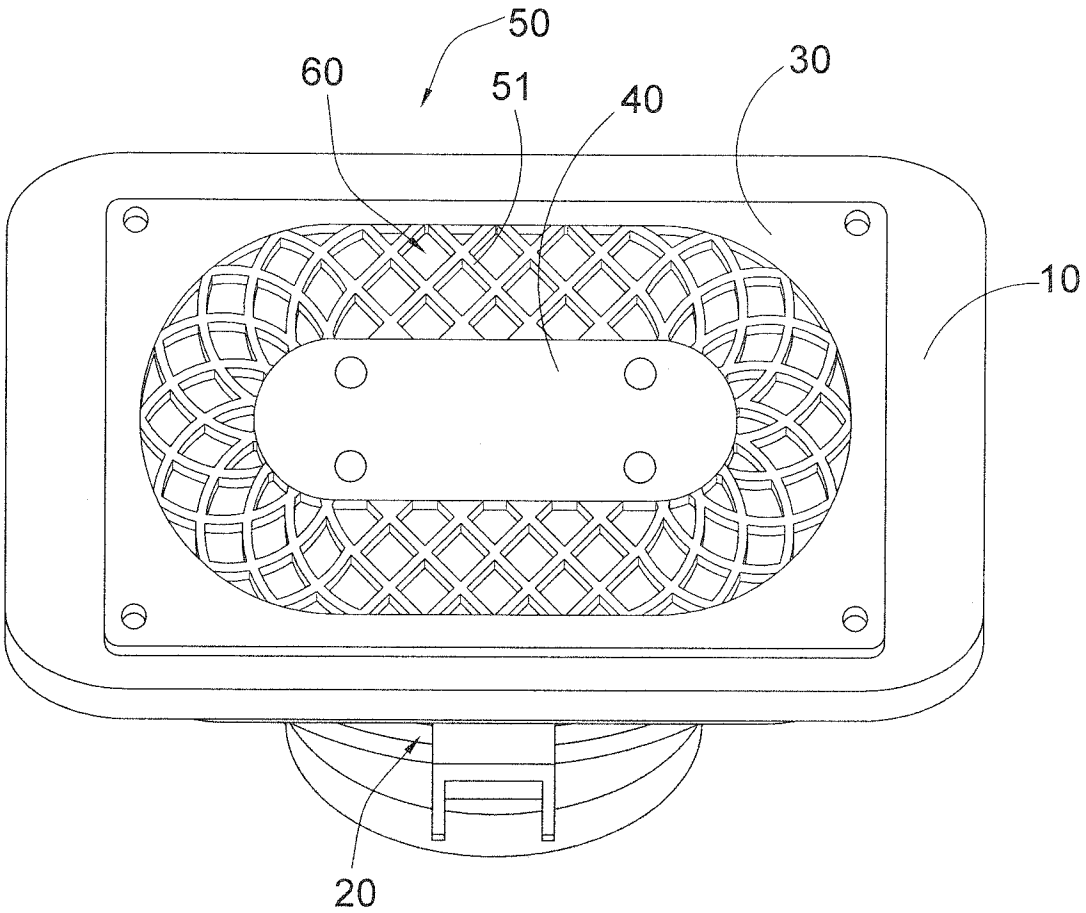
FIG. 1 a perspective view of an acoustic arrangement incorporating with a vibration unit according to a preferred embodiment of the present invention.

Referring to FIG. 1 of the drawings, an acoustic arrangement according to a preferred embodiment of the present invention is illustrated, wherein the acoustic arrangement can be formed as a speaker arrangement or equipped with another acoustic arrangement to form a speaker assembly. According to the preferred embodiment, the acoustic arrangement comprises a supporting frame 10, an electromagnetic generator 20, and a vibration unit for providing a vibration effect in response to the electromagnetic generator 20. Accordingly, the electromagnetic generator 20 comprises a magnetic coil system and a voice coil communicating with the magnetic coil system. The vibration unit of the present invention can be directly coupled with the voice coil of the electromagnetic generator 20 such that the vibration unit is reciprocatingly moved when the voice coil of the electromagnetic generator 20 is induced to reciprocatingly move. Or, the vibration unit can be a passive vibration unit to incorporate with an existing acoustic device such that when the vibration diaphragm of the existing acoustic device is vibrated by the voice coil, the vibration unit of the present invention is driven to reciprocatingly move by means of air pressure in an interior air-sealed chamber of the existing acoustic device.

According to the preferred embodiment, the vibration unit comprises an encircling frame 30 defining a vibration cavity 31 therewithin, and a vibration member 40 disposed in the vibration cavity 31 of the encircling frame 30. The vibration unit further comprises a weaving suspension 50 formed within the vibration cavity 31 and extended between the vibration member 40 and the encircling frame 30 to ensure the vibration member 40 to be reciprocatingly moved in a linear direction within the vibration cavity 31 in response to a movement of the voice coil for sound reproduction. The encircling frame 30 can be mounted to the supporting frame 10 of the acoustic arrangement in order to incorporate the acoustic arrangement with the vibration unit of the present invention.

Figure 2:
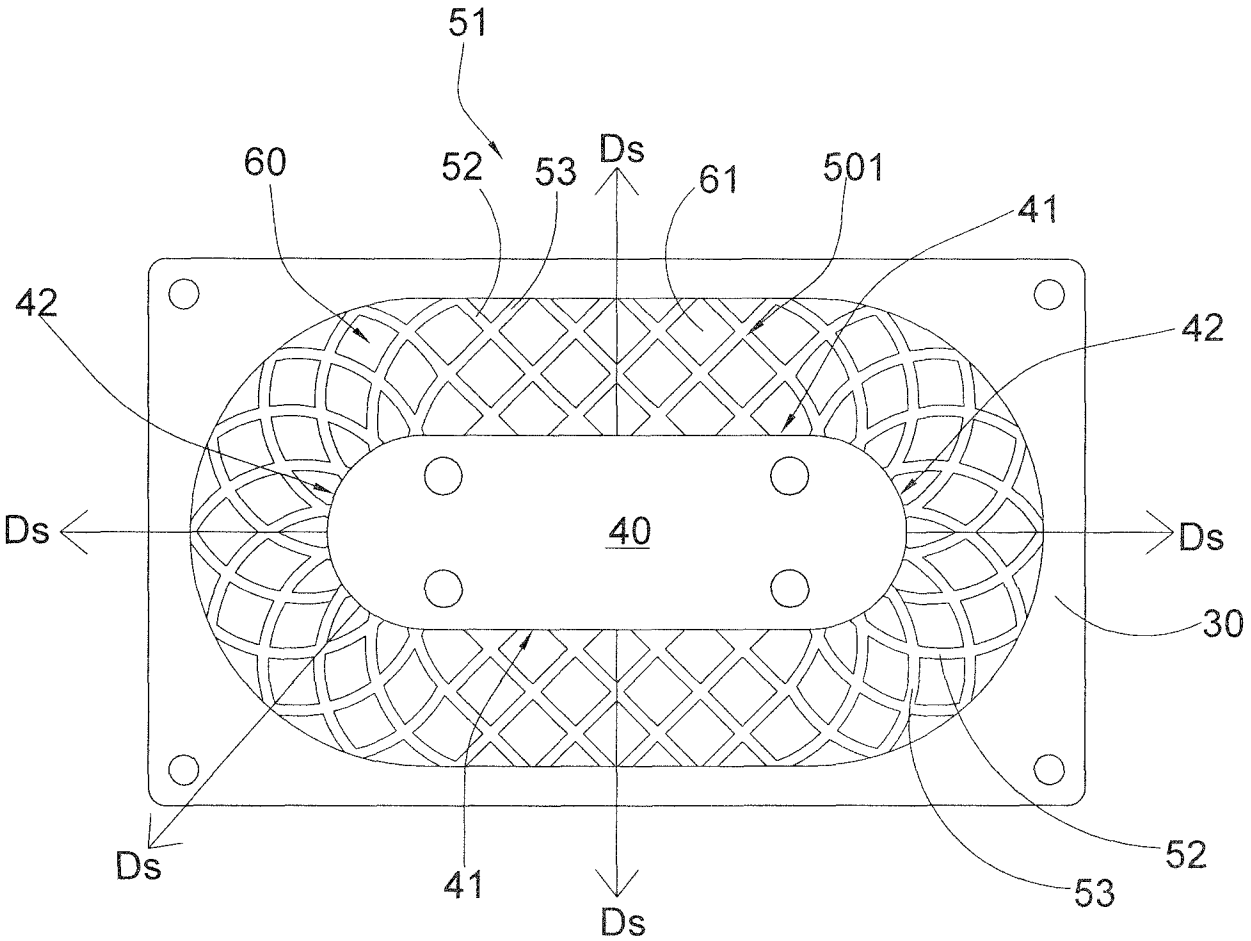
FIG. 2 is a top view of the vibration unit for the acoustic arrangement according to the above preferred embodiment of the present invention.
Figure 3:
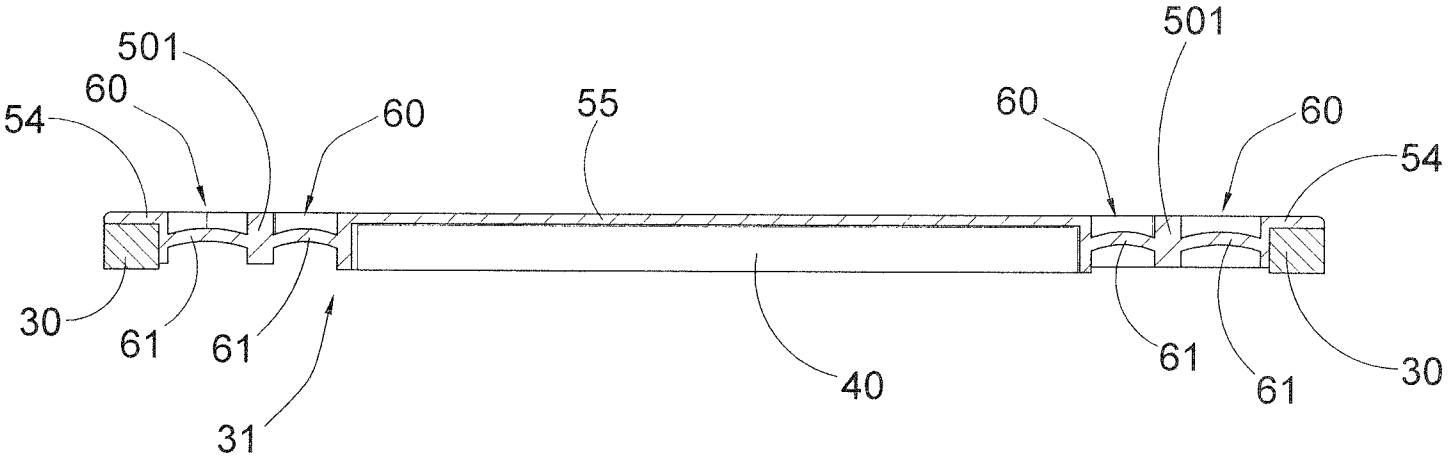
FIG. 3 is a sectional view of the vibration unit for the acoustic arrangement according to the preferred embodiment of the present invention.
Figure 4:
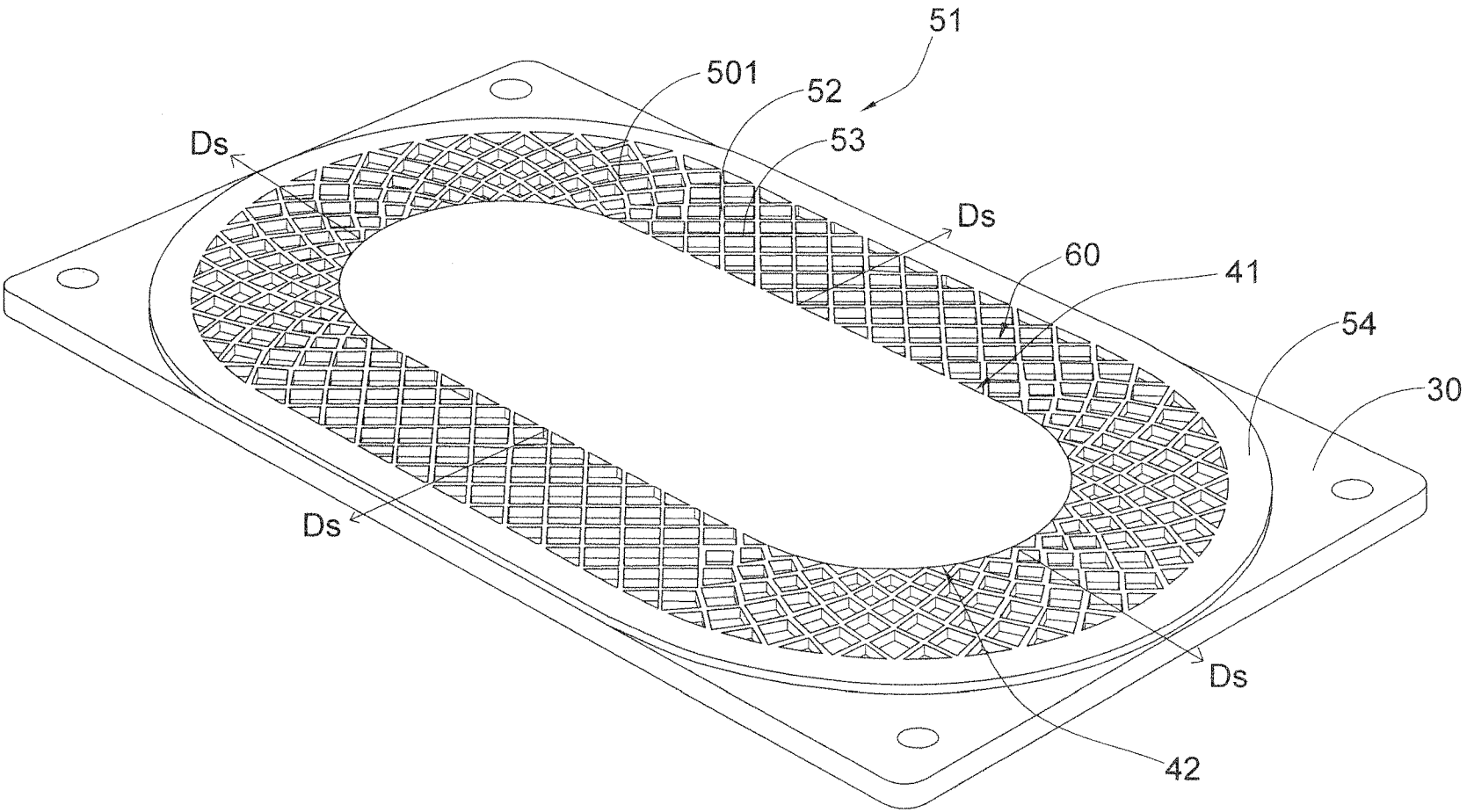
FIG. 4 is a perspective view of a vibration unit for the acoustic arrangement according to the preferred embodiment of the present invention, illustrating the increasing width of the weaving suspension.

As shown in FIGS. 2 to 4, the encircling frame 30 has a planar structure defining an outer edge and an inner edge, wherein the vibration cavity 31 is formed within the inner edge of the encircling frame 30. Preferably, the encircling frame 30 is made of rigid material, such as metal, to support and retain the vibration unit in shape.

The vibration member 40 is a planar weight member having a predetermined thickness and defining a flat top surface and a flat bottom surface. In other words, the vibration member 40 gives a predetermined weight to the vibration unit in order to vibrate or move reciprocatingly. The vibration member 40 is also a rigid panel disposed in the vibration cavity 31 in a planar direction. Preferably, the thickness of the encircling frame 30 is the same as the thickness of the vibration member 40.

The weaving suspension 50 is formed in a weaving-like structure to prohibit the vibration member 30 to be moved in a lateral direction. Accordingly, during the fabric production, two sets of threads are interlaced with each other to form a fabric. For example, the first and second sets of threads are interlaced at right angles along the X-direction and Y-direction. As a result, the fabric cannot be stretched when a stretching force is applied at the X-direction or at the Y-direction. On the other hand, the fabric can be stretched when the stretching force is applied between the X-direction or at the Y-direction, preferably an angle at 45 degrees between the X-direction or at the Y-direction. Similar to the weaving structure of the fabric, the weaving suspension 50 will only enable the vibration member 40 to be moved at one direction and will prohibit the vibration member 40 to be moved at any unwanted lateral direction.

Figure 5:
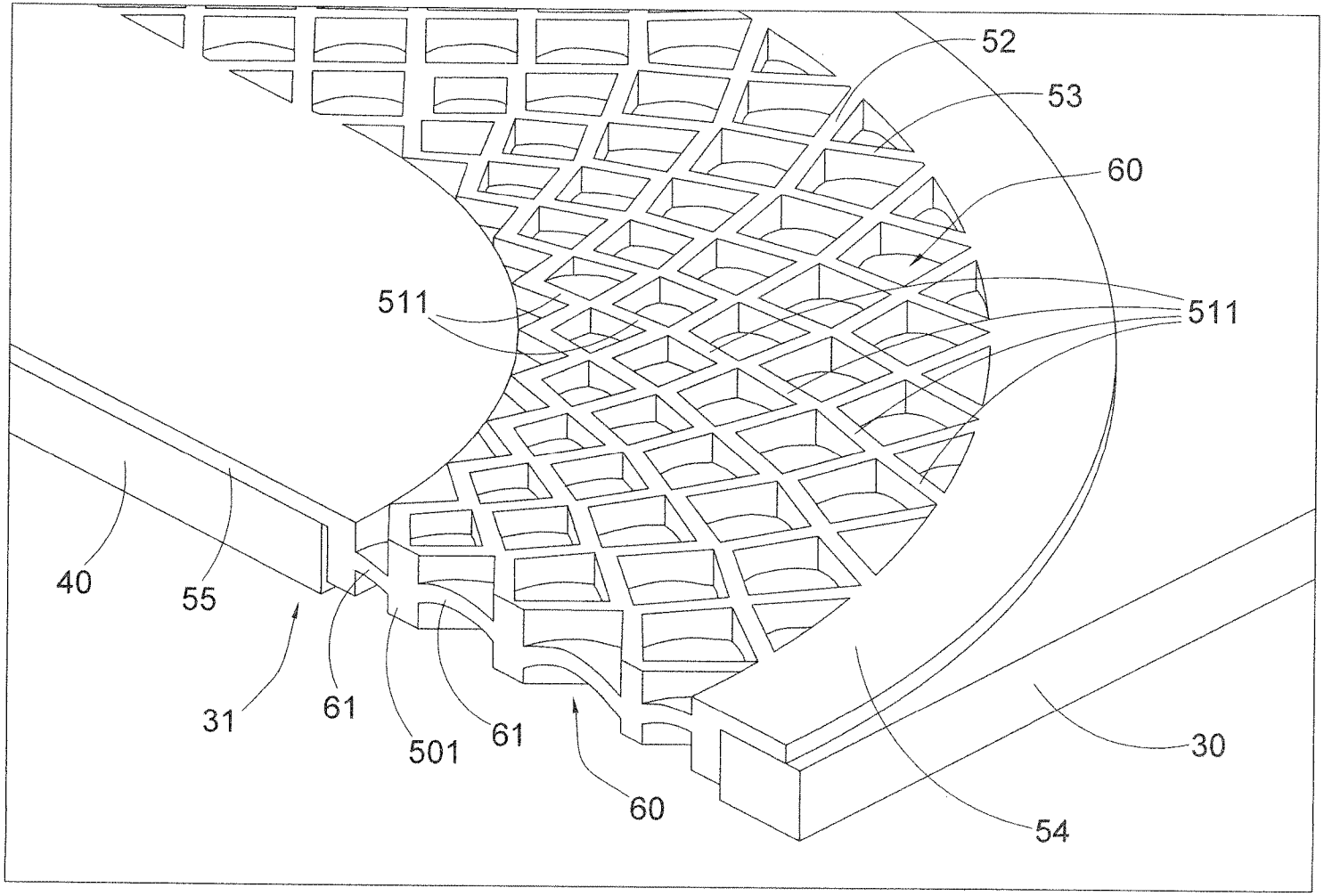
FIG. 5 is a sectional perspective view of the vibration unit for the acoustic arrangement according to the preferred embodiment of the present invention, illustrating the increasing width of the weaving suspension.

As shown in FIGS. 2, 4, and 5, the weaving suspension 50 comprises a plurality of reinforcing ribs 51 radially and outwardly extended from the peripheral edge of the vibration member 40 to the inner edge of the encircling frame 30, wherein the reinforcing ribs 50 are made of elastic material for enabling the vibration member 40 to be reciprocatingly moved in response to the movement of the voice coil. Due to the properties of the weaving structure, the reinforcing ribs 51 are extended to form the weaving-like structure that the vibration member 40 is prohibited to move along a rib extending direction of each of the reinforcing ribs 51, so as to ensure the vibration member 40 to be reciprocatingly moved in a linear direction. Accordingly, the rib direction is the direction where the reinforcing rib 51 is extended from the vibration member 40 to the encircling frame 30. Similar to the fabric structure, the fabric cannot be stretched when the stretching force is applied at the thread direction. It is worth mentioning that the reinforcing ribs 51 not only provides the elastic force to enable the vibration member 40 to move reciprocatingly but also provides the restoring force to pull the vibration member 40 back to its original. For example, when the vibration member 40 is moved upwardly, the restoring force of the reinforcing ribs 51 will pull the vibration member 40 down to its original position.

In particular, the reinforcing ribs 51 are a plurality of first skewed ribs 52 slantedly extended from the vibration member 40 to the encircling frame 30 and a plurality of second skewed ribs 53 slantedly extended from the vibration member 40 to the encircling frame 30 to intersect with the first skewed ribs 52 in order to form the weaving-like structure. The first skewed ribs 52 are inclined at one direction from the vibration member 40 to the encircling frame 30 while the second skewed ribs 53 are inclined at an opposed direction from the vibration member 40 to the encircling frame 30. As a result, the first and second skewed ribs 52, 53 are interlaced with each other.

It is worth mentioning that, unlike the weaving structure of the fabric, the first skewed ribs 52 do not extended on top or under the second skewed ribs 53 at the intersections therebetween. The first and second skewed ribs 52, 53 are integrally linked with each other at the intersections 501 therebetween. Therefore, the height of the first skewed ribs 52 is the same as the height of the second skewed ribs 53. In other words, the thickness of the reinforcing ribs 51 is uniform, even at the intersections 501 thereof, between the encircling frame 30 and the vibration member 40. Accordingly, the thickness of each of the first and second skewed ribs 52, 53 is the same as the vibration cavity 31. Therefore, there is no protrusion upwardly or downwardly protruded from the top or bottom side of the vibration unit, as shown in FIG. 3.

The vibration member 40 can be configured in different shapes. For example, the vibration member 40 can be a circular panel or a rectangular panel, wherein the vibration cavity 31 is configured correspondingly to the shape of the vibration member. In other words, when the vibration member 40 is formed in a circular shape, the vibration cavity 31 is configured to have a circular shape. When the vibration member 40 is formed in a rectangular shape, the vibration cavity 31 is configured to have a rectangular shape.

As shown in FIG. 2, the vibration member 40 is formed to have two parallel edges and two arc-shaped edges. In other words, the peripheral edge of the vibration member 40 has two straight edge portions 41 extended parallelly and two curved edge portions 42 extended from the straight edge portions 41 end-to-end. Correspondingly, the inner edge of the encircling frame 30 has two straight portions and two curved portions radially aligned with the straight edge portions 41 and the curved edge portions 42 of the vibration member 40. It is worth mentioning that the curved edge portion 42 of the vibration member 40 has a semi-circular shape that a diameter of the curved edge portion 42 of the vibration member 40 is the distance between the two straight edge portions 41 thereof.

The reinforcing ribs 51 are non-perpendicularly extended from the straight edge portion 41 of the vibration member 40 to the encircling frame 30. Furthermore, each of the reinforcing ribs 51 is a straight and elongated rib extended from the straight edge portion 41 of the vibration member 40 to the encircling frame 30. In other words, the first and second skewed ribs 52, 53 are straight and elongated ribs and are inclinedly extended from the straight edge portion 41 of the vibration member 40 to the inner edge of the encircling frame 30.

The reinforcing ribs 51 are curvedly extended from the curved edge portion 42 of the vibration member 40 to the encircling frame 30. Furthermore, each of the reinforcing ribs 51 is an elongated and arc shaped rib and is curvedly extended from the curved edge portion 42 of the vibration member 40 to the encircling frame 30. In other words, the first and second skewed ribs 52, 53 are curved and elongated ribs and are curvedly extended from the curved edge portion 42 of the vibration member 40 to the inner edge of the encircling frame 30. In particular, the first skewed ribs 52 are spirally extended to the encircling frame 30 from the curved edge portion 42 of the vibration member 40 with respect to the center of the vibration member 40 at one direction. The second skewed ribs 53 are spirally extended to the encircling frame 30 from the curved edge portion 42 of the vibration member 40 with respect to the center of the vibration member 40 at an opposed direction.

Alternatively, each of the reinforcing ribs 51 has a plurality of straight segments 511 aligned with each other to form an arc-shaped configuration, as shown in FIG. 5. Accordingly, the straight segments 511 are aligned end-to-end to form the arc-shaped configuration and to extend from the curved edge portion 42 of the vibration member 40 to the encircling frame 30.

In addition, the reinforcing ribs 51 are symmetrical with respect to a vertical centerline and a horizontal centerline of the vibration unit. In other words, the upper half section of the vibration unit is symmetrical to the lower half of the vibration unit. The right half section of the vibration unit is symmetrical to the left half of the vibration unit.

It is worth mentioning that since the reinforcing ribs 51 are interweaved to form the weaving-like structure as the surrounding of the vibration member 40, the vibration member 40 cannot be moved within the vibration cavity 31 at the lateral direction. The vibration member 40 can only moved in an up-and-down direction.

As shown in FIGS. 2 to 5, the weaving suspension 50 further comprises a plurality of displacement chambers 60 radially formed between the peripheral edge of the vibration member 40 and the encircling frame 30 for enabling the vibration member 40 to be reciprocatingly moved in response to the movement of the voice coil.

According to the preferred embodiment, each of the displacement chambers 60 has a predetermined shape to only allow the weaving suspension 50 to be radially stretched in a stretchable direction Ds along two diagonal corners of the displacement chamber 60, so as to ensure the vibration member 40 to be reciprocatingly moved in a linear direction.

The displacement chambers 60 are formed when the first and second skewed ribs 52, 53 are intersected with each other, wherein the depth of each of the displacement chambers 60 is the same or slightly larger than the depth of the vibration cavity 31, i.e. the thickness of the encircling frame 30. Accordingly, the stretchable direction Ds of the weaving suspension 50 is defined at the direction along the two diagonal corners of the displacement chamber 60. The corners of the displacement chamber 60 are the intersections of the first and second skewed ribs 52, 53.

As shown in FIG. 2, the stretchable direction Ds of the weaving suspension 50 is perpendicular to the straight edge portion 41 of the vibration member 40. Furthermore, the stretchable direction Ds of the weaving suspension 50 is a radial direction of the curved edge portion 42 of the vibration member 40 with respect to a center thereof.

Each of the displacement chambers 60 has a rhombus shape that the two opposite corners of the of the displacement chamber 60 are aligned at a radial direction of the vibration member 40. Accordingly, four edges of each of the displacement chambers 60 are equal in length.

The weaving suspension 50 further comprises a plurality of curved suspension layers 61 filled in the displacement chambers 60 respectively, wherein each of the suspension layers 61 is integrally extended within a surrounding wall of the corresponding displacement chamber 60. As shown in FIG. 5, the suspension layer 61 has a rhombus shape and defines four side edges integrally linked to four walls of the displacement chamber 60 in order to form a one piece integral unit.

Each of the suspension layers 61 is supported at a mid portion of the displacement chamber 60 to partition the vibration cavity 31 into an upper cavity and a lower cavity. Accordingly, the reinforcing ribs 51 are formed at the upper and lower cavities, wherein the reinforcing ribs 51 at the upper cavity are symmetrical to the reinforcing ribs 51 at the lower cavity. Each of the suspension layers 61 has a convex shape upwardly protruded from the corresponding displacement chamber 61. In other words, the suspension layer 61 is curved upwardly toward the upper cavity. The curved configuration of the suspension layer 61 enables the vibration member 40 to be reciprocatingly moved. It should be appreciated that the suspension layer 61 can be curved downwardly toward the lower cavity. The suspension layers 61 can evenly distribute the stretching force at the displacement chambers 60 between the inner edge of the weaving suspension 50 to the outer edge thereof, so as to ensure the reciprocating movement of the vibration member 40 in a balanced and stable manner.

Figure 6:
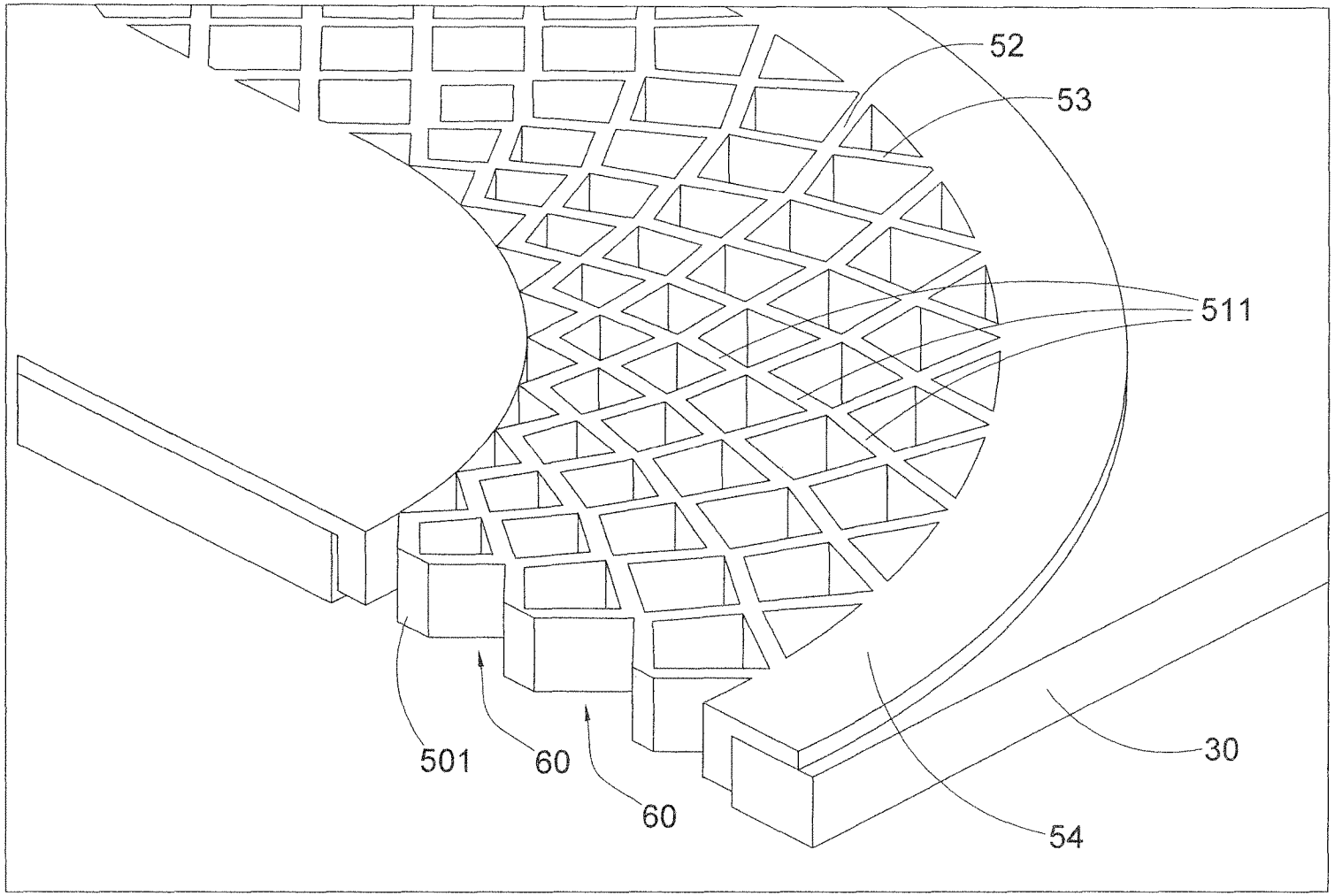
FIG. 6 is an alternative mode of the displacement chamber of the vibration unit for the acoustic arrangement according to the preferred embodiment of the present invention.

FIG. 6 illustrates an alternative mode of the weaving suspension 50, wherein each of the displacement chambers 60 is a hollow chamber. In other words, no suspension layer is formed at each hollow chamber.

It is worth mentioning that the distance between the inner edge of the encircling frame 30 and the peripheral edge of the vibration member 40 can be modified to selectively configure the width of the weaving suspension 50 depending on the size of the vibration unit. For a smaller acoustic arrangement having a smaller audio output, a smaller vibration unit will be used. The width of the weaving suspension 50 will be reduced as shown in FIG. 1 to reduce the length of each of the reinforcing ribs 51 and to reduce the number of displacement chambers 60. Accordingly, two displacement chambers 60 are alignedly formed at the weaving suspension 50 along each stretchable direction. For a bigger acoustic arrangement having a larger audio output, the width of the weaving suspension 50 will be increased to increase the length of each of the reinforcing ribs 51 and to increase the number of displacement chambers 60 as shown in FIG. 4. Accordingly, three displacement chambers 60 are alignedly formed at the weaving suspension 50 along each stretchable direction. The wider weaving suspension 50 will enable the vibration member 40 to be reciprocatingly moved with larger amplitude. The structural configuration of the weaving suspension 50 will be the same as shown in FIGS. 2 and 4.

In order to link the weaving suspension 50 between the encircling frame 30 and the vibration member 40, the weaving suspension 50 further comprises a frame retaining edge 54 integrally extended from an outer edge of the weaving suspension 50 to affix at the encircling frame 30, and a retaining layer 55 integrally extended from an inner edge of the weaving suspension 50 to embed the vibration member 40 under the retaining layer 55, so as to retain the reinforcing ribs 51 with the displacement chambers 60 between the vibration member 40 and the encircling frame 30.

As shown in FIG. 5, the frame retaining edge 54 is integrally extended from outer ends of the reinforcing ribs 51 and is affixed on top of the encircling frame 30, such that the outer ends of the reinforcing ribs 51 are extended to the inner edge of the encircling frame 30. Furthermore, the retaining layer 55 is integrally extended from inner ends of the reinforcing ribs 51 and is affixed on top of the vibration member 40, such that the inner ends of the reinforcing ribs 51 are extended to the peripheral edge of the vibration member 40.

The present invention further provides a method of manufacturing the vibration unit, which comprises the following steps.

(1) Dispose the encircling frame 30 and the vibration member 40 in a mold at a position that the vibration member 40 is located within the vibration cavity 31 of the encircling frame 30 in a planar manner.

(2) Form the weaving suspension 50 between the peripheral edge of the vibration member 40 and the encircling frame 30 in a weaving-like structure, by mold injection, for enabling the vibration member 40 to be reciprocatingly moved.

In the step (2), a raw material of the weaving suspension 50 is injected into the mold in order to form the reinforcing ribs 51 and the displacement chambers 60 between the encircling frame 30 and the vibration member 40. At the same time, the frame retaining edge 54 and the retaining layer 55 are integrally formed at the outer and inner edges of the weaving suspension 50 to affix at the encircling frame 30 and the vibration member 40 respectively. It is worth mentioning that the vibration member 40 is embedded in the retaining layer 55 when the retaining layer 55 is formed in the mold. Accordingly, the overall thickness of the weaving suspension 50 can be as thin as 2 mm. Therefore, the slim structure of the vibration unit of the present invention can be equipped with any compact product, such as the acoustic arrangement in mobile phone or laptop computer. Furthermore, the vibration unit of the present invention can be incorporated with any existing acoustic arrangement to replace the vibration diaphragm for enhancing the output sound quality and improving the durability by the vibration unit.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A vibration unit for an acoustic arrangement which comprises an electromagnetic generator being induced to generate a reciprocatingly movement, wherein said vibration unit comprises:

an encircling frame defining a vibration cavity therewithin, wherein said encircling frame has an inner edge, wherein said inner edge of said encircling frame has two straight portions and two curved portions aligned respectively with said straight portions;

a vibration member disposed in said vibration cavity of said encircling frame in a planner direction thereof, wherein said vibration member is made of rigid material, wherein said vibration member has a peripheral edge, wherein said peripheral edge of said vibration member has two straight edge portions and two curved edge portions extended respectively and outwardly from said straight edge portions; and a mold injected weaving suspension comprising a plurality of reinforcing ribs extended between said inner edge of said encircling frame and said peripheral edge of said vibration member, wherein said reinforcing ribs are made of elastic material, wherein said reinforcing ribs comprise a plurality of straight and elongated ribs extended between said straight portion of said inner edge of said encircling frame and said corresponding straight edge portion of said peripheral edge of said vibration member and a plurality of elongated and arc shaped ribs extended between said curved portion of said inner edge of said encircling frame and said corresponding curved edge portion of said peripheral edge of said vibration member, so as to ensure said vibration member to be reciprocatingly moved in a linear direction in response to a movement of said electromagnetic generator for sound reproduction.

2. The vibration unit, as recited in claim 1, wherein said elongated and arc shaped ribs of said reinforcing ribs comprise a plurality of first and second skewed ribs, wherein said first skewed ribs and said second skewed ribs are intersected with each other to define a plurality of displacement chambers, so as to provide a plurality of elastic moving spaces for allowing said vibration member to be reciprocatingly moved in a linear direction.

3. The vibration unit, as recited in claim 2, wherein said first straight ribs are slantedly extended from said curved portion of said inner edge of said encircling frame to said curved edge portion of said peripheral edge of said vibration member at one direction, and said second straight ribs are slantedly extended from said curved portion of said inner edge of said encircling frame to said curved edge portion of said peripheral edge of said vibration member at an opposed direction to make said first straight ribs and said second straight ribs be intersected with each other.

4. The vibration unit, as recited in claim 1, wherein said straight and elongated ribs of said reinforcing ribs comprise a plurality of first and second straight ribs, wherein said first straight ribs and said second straight ribs are intersected with each other to define a plurality of displacement chambers, so as to provide a plurality of elastic moving spaces for allowing said vibration member to be reciprocatingly moved in a linear direction.

5. The vibration unit, as recited in claim 1, wherein said straight and elongated ribs of said reinforcing ribs comprise a plurality of first and second straight ribs and said elongated and arc shaped ribs of said reinforcing ribs comprise a plurality of first and second skewed ribs, wherein said first straight ribs and said second straight ribs are intersected with each other and said first skewed ribs and said second skewed ribs are intersected with each other, so as to define a plurality of displacement chambers to provide a plurality of elastic moving spaces for allowing said vibration member to be reciprocatingly moved in a linear direction.

6. The vibration unit, as recited in claim 5, wherein each of said displacement chambers has a rhombus shape that two diagonal corners of each of said displacement chambers are aligned at a radial direction of said vibration member.

7. The vibration unit, as recited in claim 6, wherein said weaving suspension further comprises a plurality of curved suspension layers, wherein each of said curved suspension layers is integrally extended between said two diagonal corners of said displacement chamber.

8. The vibration unit, as recited in claim 7, wherein each of said suspension layers has a convex shape upwardly protruded from said corresponding displacement chamber.

9. The vibration unit, as recited in claim 8, wherein said first skewed ribs are slantedly extended from said curved portion of said inner edge of said encircling frame to said curved edge portion of said peripheral edge of said vibration member at one direction, and said second skewed ribs are slantedly extended from said curved portion of said inner edge of said encircling frame to said curved edge portion of said peripheral edge of said vibration member at an opposed direction to make said first skewed ribs and said second skewed ribs be intersected with each other, wherein said first straight ribs are slantedly extended from said curved portion of said inner edge of said encircling frame to said curved edge portion of said peripheral edge of said vibration member at one direction, and said second straight ribs are slantedly extended from said curved portion of said inner edge of said encircling frame to said curved edge portion of said peripheral edge of said vibration member at an opposed direction to make said first straight ribs and said second straight ribs be intersected with each other.

10. The vibration unit, as recited in claim 5, wherein said weaving suspension further comprises a frame retaining edge integrally extended from an outer edge of said weaving suspension to affix at said encircling frame, and a retaining layer integrally extended from an inner edge of said weaving suspension to embed said vibration member under said retaining layer, so as to retain said reinforcing ribs between said vibration member and said encircling frame.

11. The vibration unit, as recited in claim 1, wherein said first skewed ribs are slantedly extended from said curved portion of said inner edge of said encircling frame to said curved edge portion of said peripheral edge of said vibration member at one direction, and said second skewed ribs are slantedly extended from said curved portion of said inner edge of said encircling frame to said curved edge portion of said peripheral edge of said vibration member at an opposed direction to make said first skewed ribs and said second skewed ribs be intersected with each other.

12. The vibration unit, as recited in claim 1, wherein each of elongated and arc shaped ribs has a plurality of straight segments aligned with each other.

13. The vibration unit, as recited in claim 1, wherein each of straight and elongated ribs has a plurality of straight segments aligned with each other.

14. The vibration unit, as recited in claim 13, wherein said weaving suspension further comprises a frame retaining edge integrally extended from an outer edge of said weaving suspension to affix at said encircling frame, and a retaining layer integrally extended from an inner edge of said weaving suspension to embed said vibration member under said retaining layer, so as to retain said reinforcing ribs between said vibration member and said encircling frame.

15. The vibration unit, as recited in claim 14, wherein the thickness of said encircling frame is the same as the thickness of said vibration member.

16. The vibration unit, as recited in claim 1, wherein the thickness of said encircling frame is the same as the thickness of said vibration member.

17. The vibration unit, as recited in claim 1, wherein each of said curved edge portions of said vibration member has a semi-circular shape that a diameter of each of said curved edge portions of said vibration member is the distance between said two straight edge portions thereof.

18. A vibration unit for an acoustic arrangement which comprises an electromagnetic generator being induced to generate a reciprocatingly movement, wherein said vibration unit comprises:

an encircling frame defining a vibration cavity therewithin;

a vibration member disposed in said vibration cavity of said encircling frame in a planner direction thereof; and a mold injected weaving suspension defining a plurality of displacement chambers radially formed between a peripheral edge of said vibration member and said encircling frame for enabling said vibration member to be reciprocatingly moved in response to a movement of said electromagnetic generator, wherein at least two displacement chambers are aligned between said peripheral edge of said vibration member and said encircling frame along a stretchable direction, wherein said mold injected weaving suspension comprises a plurality of reinforcing ribs extended between said encircling frame and said vibration member, wherein said reinforcing ribs comprise a plurality of straight and elongated ribs intersected with each other and a plurality of elongated and arc shaped ribs intersected with each other to form said displacement chambers, wherein each of said displacement chambers has a predetermined shape to only allow said weaving suspension to be radially stretched in the stretchable direction along two diagonal corners of said displacement chamber, wherein said two diagonal corners of each of said displacement chambers are aligned at a radial direction of said vibration member, so as to ensure said vibration member to be reciprocatingly moved in a linear direction in response to a movement of said electromagnetic generator for sound reproduction.

19. The vibration unit, as recited in claim 18, wherein said weaving suspension further comprises a plurality of curved suspension layers, wherein each of said curved suspension layers is integrally extended between said two diagonal corners of said displacement chamber.

20. The vibration unit, as recited in claim 19, wherein said peripheral edge of said vibration member has two straight edge portions and two curved edge portions extended respectively and outwardly from said straight edge portions, wherein each of said curved edge portions of said vibration member has a semi-circular shape that a diameter of each of said curved edge portions of said vibration member is the distance between said two straight edge portions thereof.

* * * * *